US006951057B2

(12) United States Patent
Yoshida et al.

(10) Patent No.: US 6,951,057 B2
(45) Date of Patent: Oct. 4, 2005

(54) PORTABLE CIRCULAR SAW HAVING CIRCULAR SAW BLADE INCLINATION ANGLE CONTROLLING ARRANGEMENT

(75) Inventors: Kenichirou Yoshida, Hitachinaka (JP); Takuma Nonaka, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 41 days.

(21) Appl. No.: 10/338,677

(22) Filed: Jan. 9, 2003

(65) Prior Publication Data

US 2003/0131484 A1 Jul. 17, 2003

(30) Foreign Application Priority Data

Jan. 16, 2002 (JP) ..... P2002-007795

(51) Int. Cl.[7] ..... B27B 5/70
(52) U.S. Cl. ..... 30/376
(58) Field of Search ..... 70/376, 391, 375

(56) References Cited

U.S. PATENT DOCUMENTS 2,543,486 A * 2/1951 Briskin ..... 30/376
3,292,673 A * 12/1966 Gregory ..... 30/377
5,121,545 A 6/1992 Nonaka et al.
5,452,515 A * 9/1995 Schilling ..... 30/376
5,570,511 A * 11/1996 Reich et al. ..... 30/376
6,202,311 B1 * 3/2001 Nickels, Jr. ..... 30/376
6,601,305 B1 * 8/2003 Fukuoka ..... 30/376
2001/0037578 A1 * 11/2001 Mori et al. ..... 30/376

* cited by examiner

*Primary Examiner*—Charles Goodman
(74) *Attorney, Agent, or Firm*—Sughrue Mion, PLLC

(57) ABSTRACT

A portable circular saw providing high visibility to a cutting mark line and sufficient operability even in case of an angled cutting. A slant position fixing member upstands from a front side of a base, and a tiltable plate is provided pivotally to the base. A front end of a saw cover is connected to the tiltable plate by a pivot pin. A main body roratably supporting a circular saw blade is pivotally movable by a pivotal movement of the tiltable plate to change inclination of the circular saw blade relative to the base. The tiltable plate is positioned in confrontation with the slant position fixing member, and fastening unit fixes the tiltable plate to the slant position fixing member to maintain a desired inclination of the circular saw blade. The fastening unit includes a thread extending through an arcuate slot formed in the slant position fixing member and engaging the tiltable plate, and a lever fixed to one end of the thread. The lever has a pressure surface in pressure contact with an abutment surface of the slant position fixing member. The abutment surface is in a form of a slant surface.

22 Claims, 9 Drawing Sheets

PORTABLE CIRCULAR SAW HAVING CIRCULAR SAW BLADE INCLINATION ANGLE CONTROLLING ARRANGEMENT

BACKGROUND OF THE INVENTION

The present invention relates to a portable circular saw having a rotatably driven circular saw blade, and more particularly, to a type having an arrangement for controlling a lateral inclination angle of a circular saw blade with respect to a base.

A conventional portable circular saw is shown in FIGS. 14 and 15. The conventional portable circular saw 101 includes a base 10 arranged in opposition to a workpiece to be cut, and a main body 120 pivotally movably supported to the base 10. The base 10 is placed on the workpiece during cutting operation.

The main body 120 rotatably supports a circular saw blade 21. The saw blade 21 is rotatable about an axis of a saw blade shaft 21A. The main body 120 houses therein an electric motor (not shown) and a power transmission mechanism (not shown) for rotatably driving the circular saw blade 21. Further, a main handle 22 is provided at a top end of the main body 120, and a subordinate handle 23 is provided at a front side of the main body 120. The term "front" and "rear" will be referred to in connection with a cutting direction. A saw cover 124 is provided integrally with the main body 120 for covering an upper half of the circular saw blade 21. Further, a safety cover (not shown) is provided pivotably movably about the saw blade shaft 21A for covering a lower half portion of the circular saw blade 21 during non-operating state. The safety cover is provided with a safety cover lever 25. A user can manually hold the safety cover lever 25 at its suitable angular position for maintaining a pivot position of the safety cover. When cutting a workpiece W from its rear end to its front end, the safety cover is automatically pivotally moved about the saw blade shaft 21A to automatically expose the lower half region of the circular saw blade 21 to an atmosphere. On the other hand, if the circular saw is to be moved from the front end to the rear end of the workpiece for forming a window or a frame hole, the safety cover lever 25 is latched by a user's finger to maintain an open state of the safety cover.

A slant position fixing member 111 upstands from the base 10. The slant position fixing member 111 is positioned at a front side of the base 10 and is provided with a scale or a gauge indicating an inclination angle of the circular saw blade 21 with respect to the base 10. A tiltable plate 126 is provided integrally with the front side of the saw cover 124 and at a position in confrontation with the slant position fixing member 111. The tiltable plate 126 is pivotally movably supported to the slant position fixing member 111 through a pin 12. The pin 12 extends in parallel with the base 10 and in a direction perpendicular to the saw blade shaft 21A. Therefore, the main body 120 is pivotally movable about the pin 12 between its upstanding position shown in FIG. 14 and a slanting position shown in FIG. 15.

The slant position fixing member 111 is formed with an arcuate slot 111*a* whose center of radius is coincident with an axis of the pin 12 serving as a pivot shaft of the tiltable plate 126. A fastening unit 30 is provided for fixing the pivot position of the tiltable plate 126 with respect to the slant position fixing member 111 when a tilting angle of the circular saw blade 21 with respect to the base 10 becomes a desired angle. The fastening unit 30 includes a thread and a lever 31. The thread penetrates through the arcuate slot 111*a* and threadingly engages the tiltable plate 126. The lever 31 is provided at one end of the thread. A base end face of the lever 31 serves as a pressure surface. In accordance with the threading advancing and retracting movement of the thread in accordance with the pivotal movement of the lever 31, the pressure surface of the lever 31 presses against the slant position fixing member 111 or is released therefrom. Because the lever 31 is provided, the thread can be rotated with a reduced force without employing a tool. The lever 31 is directed in parallel with the base 10 when the circular saw blade 21 is directed perpendicular to the base 10.

In use of the portable circular saw 101, when the circular saw blade 21 is directed perpendicular to the base 10 as shown in FIG. 14, the main body 120 is pressed against the workpiece W while the main handle 22 and the subordinate handle 23 are gripped by a right hand and a left hand, respectively. Then the base 10 is slidingly moved frontwardly on the workpiece W. In this case, an area of the workpiece in immediately front of the circular saw blade 21 can easily be observed, since the lever 31 is directed in substantially parallel with the base 10. Therefore, the user can perform cutting operation while acknowledging an inked marking line M. Further, an operator's finger pressing the subordinate handle 23 does not abut against the lever 31.

On the other hand, if an angled cutting as shown in FIG. 15 is to be performed, the lever 31 is temporarily unfastened for allowing the main body 120 to be pivotally moved, about the pin 12, relative to the base 10 so as to provide a desired tilting angle θ of the circular saw blade 21 with respect to the base 10. With this pivotal movement, relative position of the tiltable plate 126 with respect to the slant position fixing member 111 is changed. Then, the lever 31 is fastened to fix the posture of the tiltable plate 126 to the slant position fixing member 111. Consequently, tilting angle θ of the circular saw blade 21 is fixed.

However, in case of the angled cutting shown in FIG. 15 with the conventional portable circular saw, the lever 31 upon completion of fastening does not horizontally extend but rises up at its free end in accordance with the tilting angle θ of the circular saw blade 21, because pivotal amount to the complete fastening is uniform. The rising up lever 31 may interrupt a sight for observing the inked marking line M which is a guide line for cutting. Accordingly, a cutting direction cannot be accurately understood by the operator. Moreover, the operator's finger holding the subordinate handle 23 may be pressed against the rising lever 31. That is, the lever 31 becomes an obstacle for a smooth cutting operation.

In order to prevent the finger from being abutted against the lever 31, the subordinate handle 23 must be displaced rearwardly, i.e., must be positioned closer to the main handle 22. However, with such an arrangement, force imbalance may occur for holding the portable circular saw 101, and further, operability of the portable circular saw 101 in case of forming a window may be remarkably degraded. To be more specific, in cutting operation for forming a window, the safety lever 25 must be manually held at a frontward pivot position as shown in FIG. 14. Here, a hand of a finger that hold the safety cover lever 25 also holds the subordinate handle 23. Therefore, if the subordinate handle 23 is disposed close to the main handle 22, it becomes impossible to hold the safety cover lever 25 at its frontwardly shifting position by the finger of the hand while that hand also holds the subordinate handle 23. Consequently, a desirable cutting operation for forming a window cannot be performed.

Further, the subordinate handle 23 is preferably positioned spaced away from the circular saw blade 21 in the axial direction of the saw blade shaft 21A so as to easily observe the circular saw blade 21 when the operator looks down and peeps into the circular saw blade 21. However, due to the spaced away location of the subordinate handle 23, the rising-up free end of the lever 31 may abut the subordinate handle 23 to lower operability of the subordinate handle 23.

SUMMARY OF THE INVENTION

It is an object of the present invention to overcome the above-described problems and to provide an improved portable circular saw capable of providing a sufficient operability and capable of easily observing a cutting direction even in case of the angled cutting.

This and other objects of the present invention will be attained by a portable circular saw including a base, a main body, a slant position fixing member, a tiltable plate, and a fastening unit. The base is to be opposed to a workpiece. The main body rotatably supports a circular saw blade and is pivotally movable relative to the base. The slant position fixing member upstands from the front portion of the base. The slant position fixing member has an abutment surface. The tiltable plate is connected to the main body and is positioned in confrontation with the slant position fixing member and is pivotally movable relative to the base about a pivot axis. The fastening unit includes a thread and a lever member. The thread passes through the slant position fixing member and is threadingly engaged with the tiltable plate. The lever member is provided at one end of the thread and has a pressure surface in pressure contact with the abutment surface of the slant position fixing member for fixing the tiltable plate to the slant position fixing member to maintain a desired slant angle of the circular saw blade with respect to the base. The abutment surface is configured to increase rotation angle of the thread in accordance with an increase in slant angle of the circular saw blade.

DETAILED DESCRIPTION OF THE PREFERRED EMBODIMENTS

Figure 1:
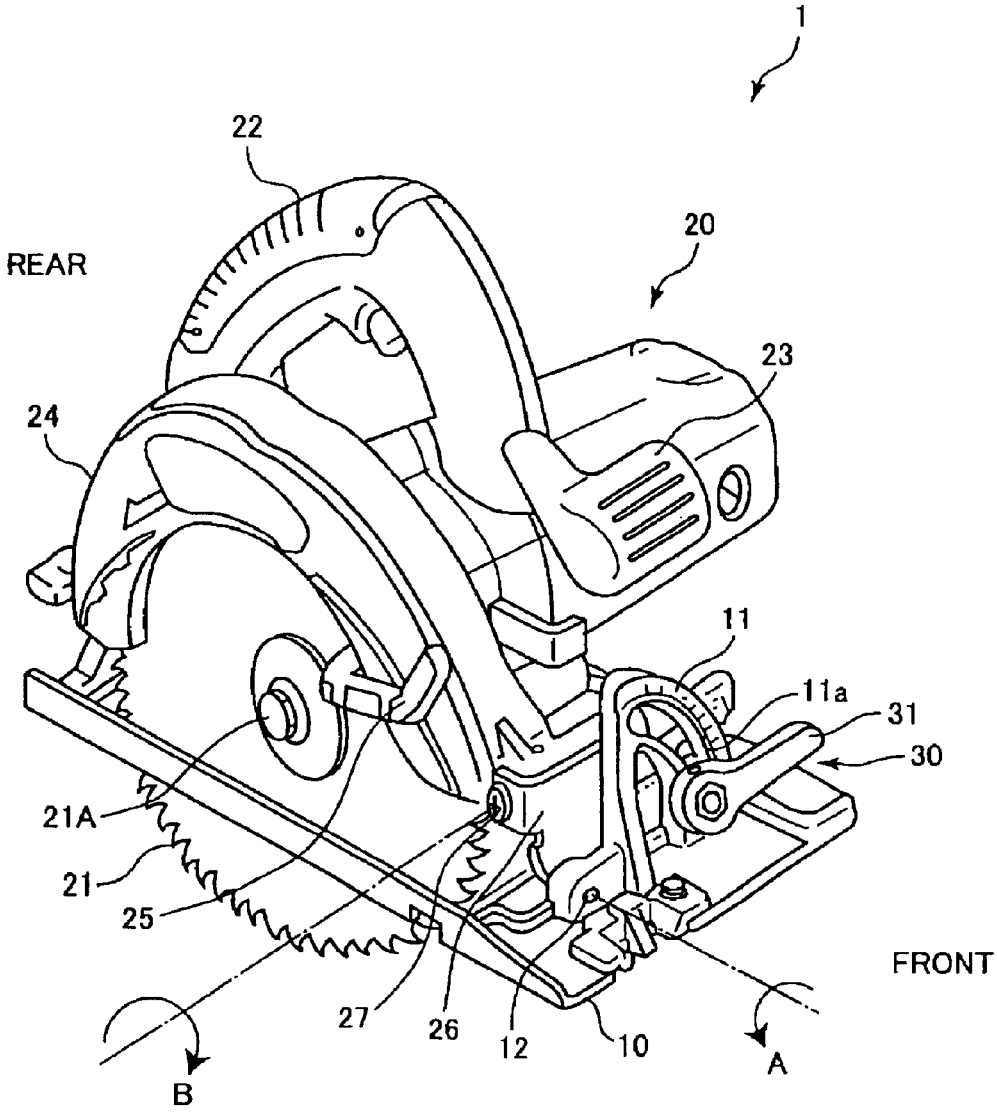
FIG. 1 is a perspective view showing a portable circular saw according to a first embodiment of the present invention.

A portable circular saw according to a first embodiment of the present invention will be described with reference to FIGS. 1 through 7. In the drawings, like parts and components are designated by the same reference numerals and characters as those shown in FIGS. 14 and 15.

Figure 2:
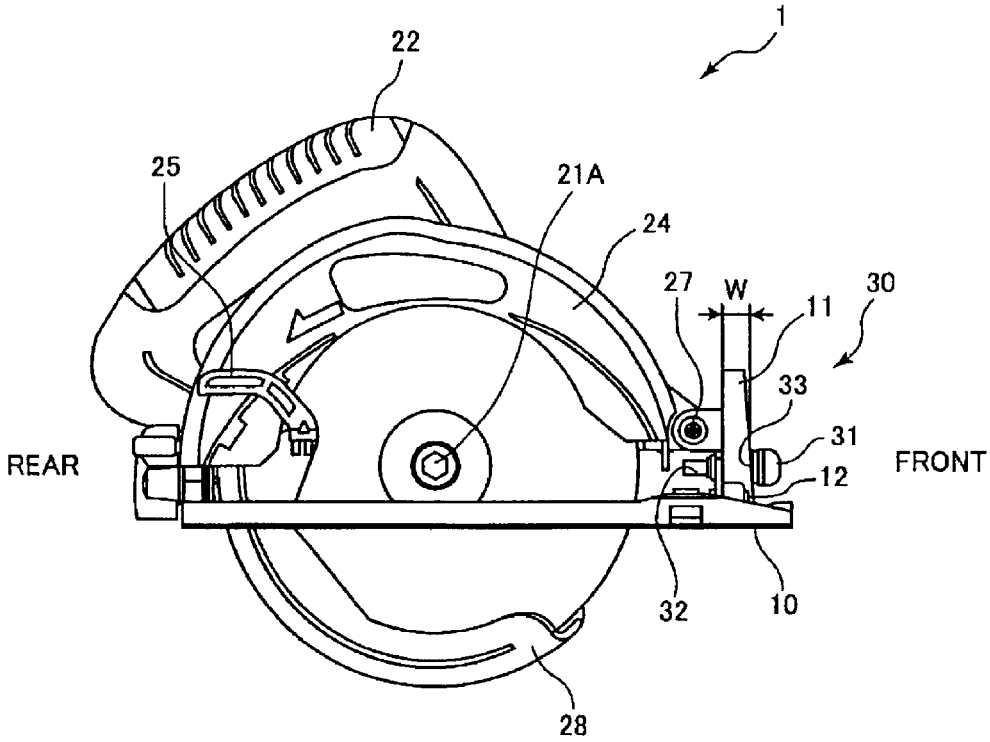
FIG. 2 is the side view showing the portable circular saw according to the first embodiment.
Figure 14:
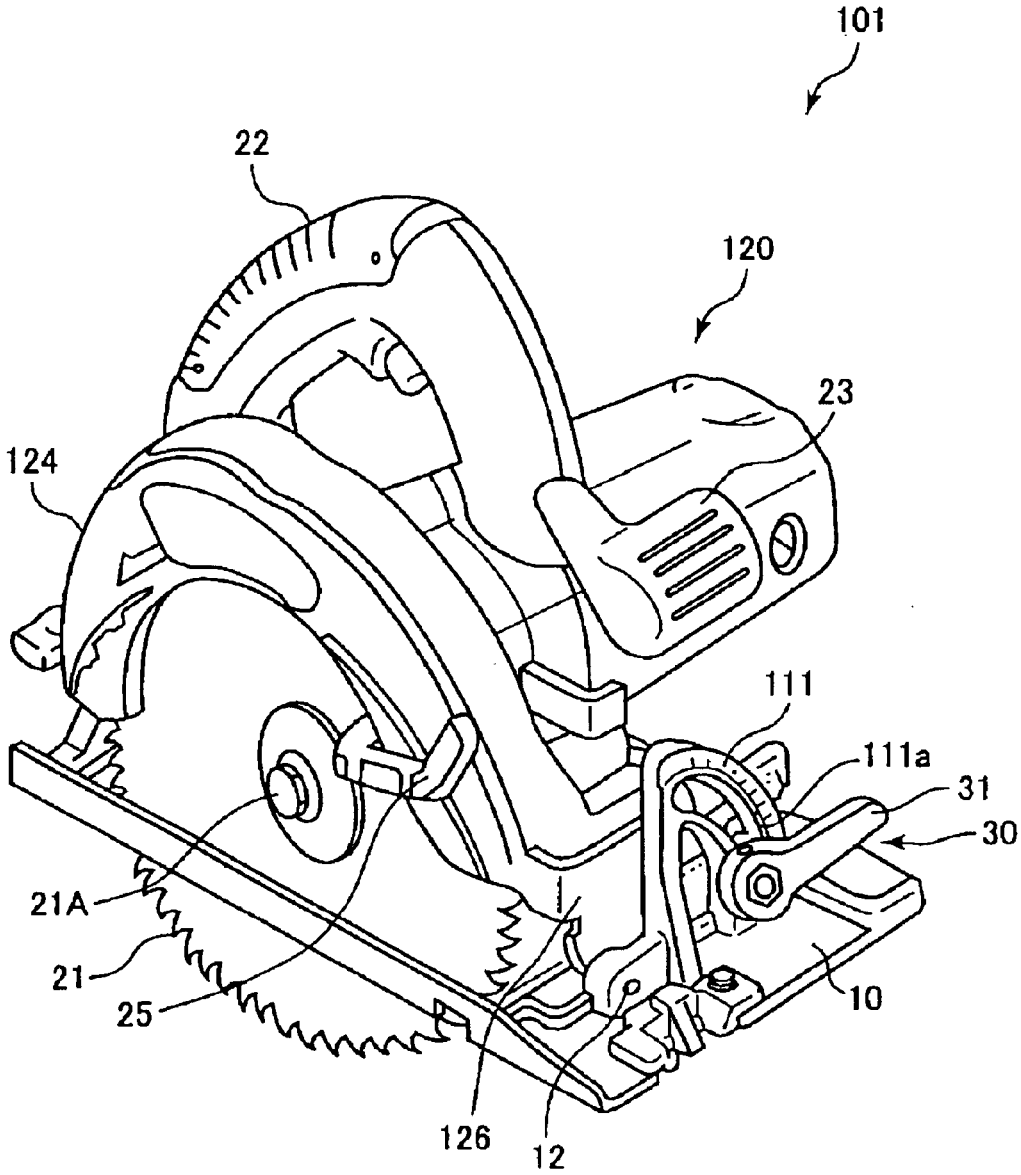
FIG.14 PRIOR ART
FIG. 14 is a perspective view showing a conventional portable circular saw.
Figure 15:
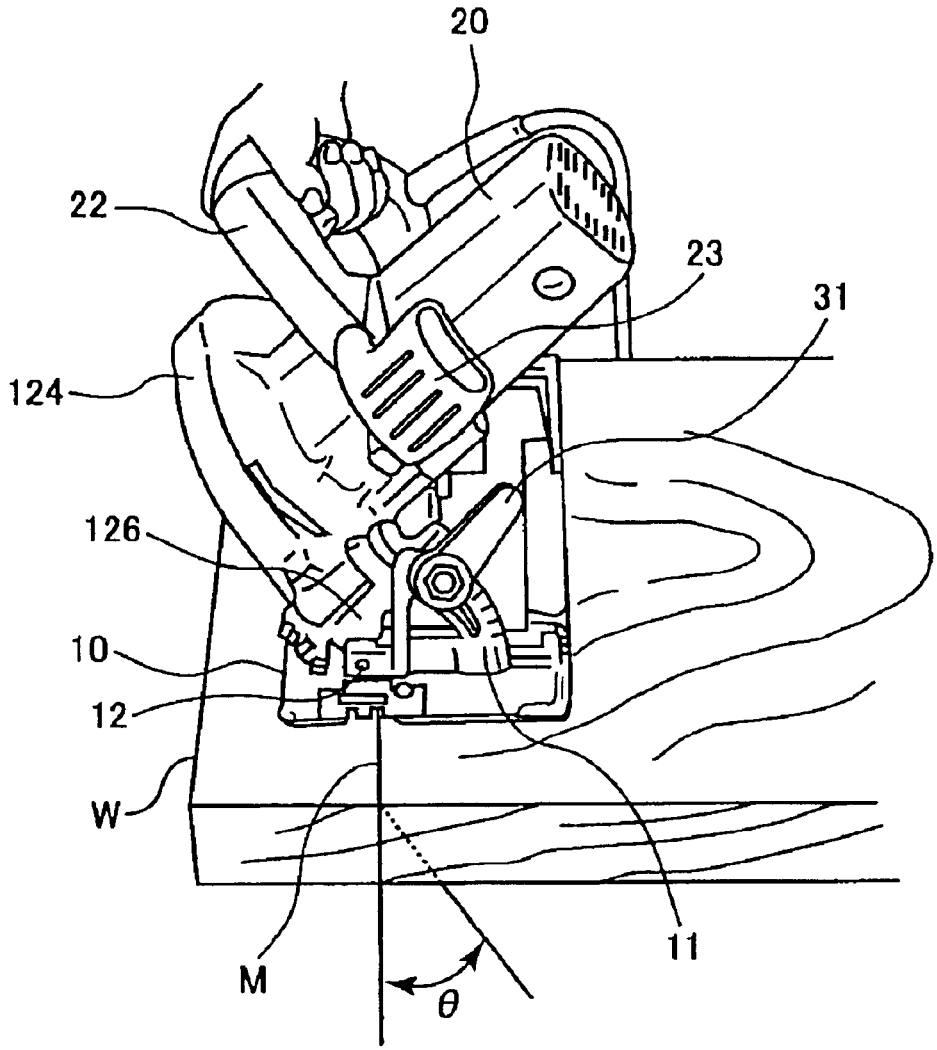
FIG.15 PRIOR ART
FIG. 15 is a perspective view showing a posture of the conventional portable circular saw in its angled cutting operation.

A portable circular saw 1 according to the first embodiment has a main body 20 substantially the same as the main body 120 shown in FIG. 14 except a slant position fixing member 11. Incidentally, FIG. 2 shows a saw cover 24 provided integrally with the main body 20 for covering an upper half region of the circular saw blade 21, and a safety cover 28 for covering a lower half region of the circular saw blade 21 during non-operating state of the portable circular saw 1. As described above, the safety cover 28 is pivotally movable about a saw blade shaft 21A, and is provided integrally with a safety cover lever 25 for maintaining a pivot position of the safety cover 28 by an operator's finger tip.

The saw cover 24 has a front end portion pivotally movably connected to a tiltable plate 26 by a pivot pin 27. Further, the tiltable plate 26 is pivotally movable about a pin 12 in a direction indicated by an arrow A. Therefore, an inclination angle of the circular saw blade 21 with respect to a base 10 can be changeable in a direction indicated by the arrow A in accordance with the pivotal position of the main body 20 in the direction A. Thus, angled cutting (FIG. 7) can be performed. Further, a vertical position of the circular saw blade 21 with respect to the base 10 can also be changed in accordance with the pivotal movement of the main body 20 about the pivot pin 27 in a direction indicated by an arrow B. When the main body 20 is pivotally moved in the direction B, the main body 20 provides its hip-up posture in a cutting direction wherein a rear portion of the main body 20 is positioned higher than a front portion thereof. Thus, a cutting depth of the circular saw blade 21 relative to a workpiece can be adjusted.

Figure 3:
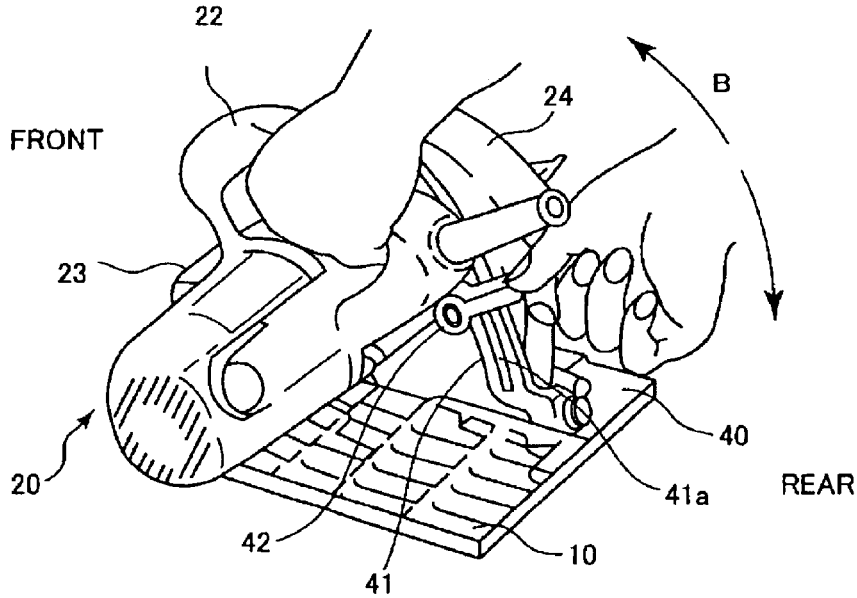
FIG. 3 is a perspective view for description of a manipulation of a cutting depth adjusting mechanism provided in the portable circular saw according to the first embodiment.

A cutting depth adjusting mechanism 40 is shown in FIG. 3. This mechanism 40 is adapted for controlling and maintaining a desired hip-up posture of the main body 20. A link 41 upstands from an upper rear surface of the base 10 at a position immediately behind the saw cover 24. The link 41 is formed with an arcuate slot 41*a* whose center of radius is coincident with the pivot pin 27. A clamp lever 42 is pivotally movably provided at a rear portion of the main body 20. The clamp lever 42 is provided with a bolt (not shown) extending through the arcuate slot 41*a* and threadingly engaging with the saw cover 24. By the pivotal manipulation of the clamp lever 42, a hip up posture of the main body 20 can be fixed or released. For example, in FIG. 3, if the main body 20 is pivotally moved in a direction indicated by the arrow B and the position is fixed by the clamp lever 42, an amount of projection of the circular saw blade 21 from the lower face of the base 10 is decreased to provide a shallow cutting depth.

Further, the subordinate handle 23 is positioned at a front side of the main body 20 in the cutting direction and at a position as low as possible with respect to the main body 20. With this arrangement, the subordinate handle 23 can be positioned spaced away from the main handle 22 for facilitating holding of the portable circular saw 1 in a well-balanced manner during cutting operation.

A fastening unit 30 (described later) includes a thread 32 and a lever 31. The subordinate handle 23 is positioned farther away from the circular saw blade 21 in the axial direction of the saw blade shaft 21A than the thread 32 is from the circular saw blade 21. Therefore, the circular saw blade 21 can be observed easily without obstruction of the subordinate handle 23 when the operator peeps into the circular saw blade 21 during cutting operation.

The slant position fixing member 11 upstands from the front side of the base 10 in the cutting direction. The slant position fixing member 11 has a width W (FIG. 2) in the cutting direction gradually narrower toward its top. The slant position fixing member 11 is formed with an arcuate slot 11*a* (FIG. 1) whose center of radius is coincident with the axis of the pin 12 serving as a pivot shaft of the tiltable plate 26. The fastening unit 30 is adapted for fixing the tiltable plate 26 to the slant position fixing member 11 when the circular saw blade 21 is tilted relative to the base 10 at a desired angle.

The thread 32 of the fastening unit 30 extends through the arcuate slot 11*a* and threadingly engages the tiltable plate 26, and the lever 31 is connected to one end of the thread 32. The lever 31 has a base end face portion which serves as a pressure surface 33 pressing against the slant position fixing member 11 upon threading advancing and retracting movement of the thread 32 by the pivotal movement of the lever 31 so as to maintain and release the tilting angle of the main body 20. The thread 32 can be rotated about its axis by the lever 31 with a reduced force without any additional tool.

In the illustrated embodiment, the fastening unit 30 and the slant position fixing member 11 are arranged such that the free end of the lever 31 can be positioned at the same level of or lower than the height of the thread 32 upon completion of fastening regardless of the tilting angle of the circular saw blade 21 with respect to the base 10. That is, the slant position fixing member 11 has an abutment surface 11A in pressure contact with the pressure surface portion 33. The abutment surface 11A is a slant surface inclined at a predetermined angle so as to permit the rotation angle of the thread 32 about its axis to increase in proportion to an increase in the tilting angle of the circular saw blade 21.

Figure 4:
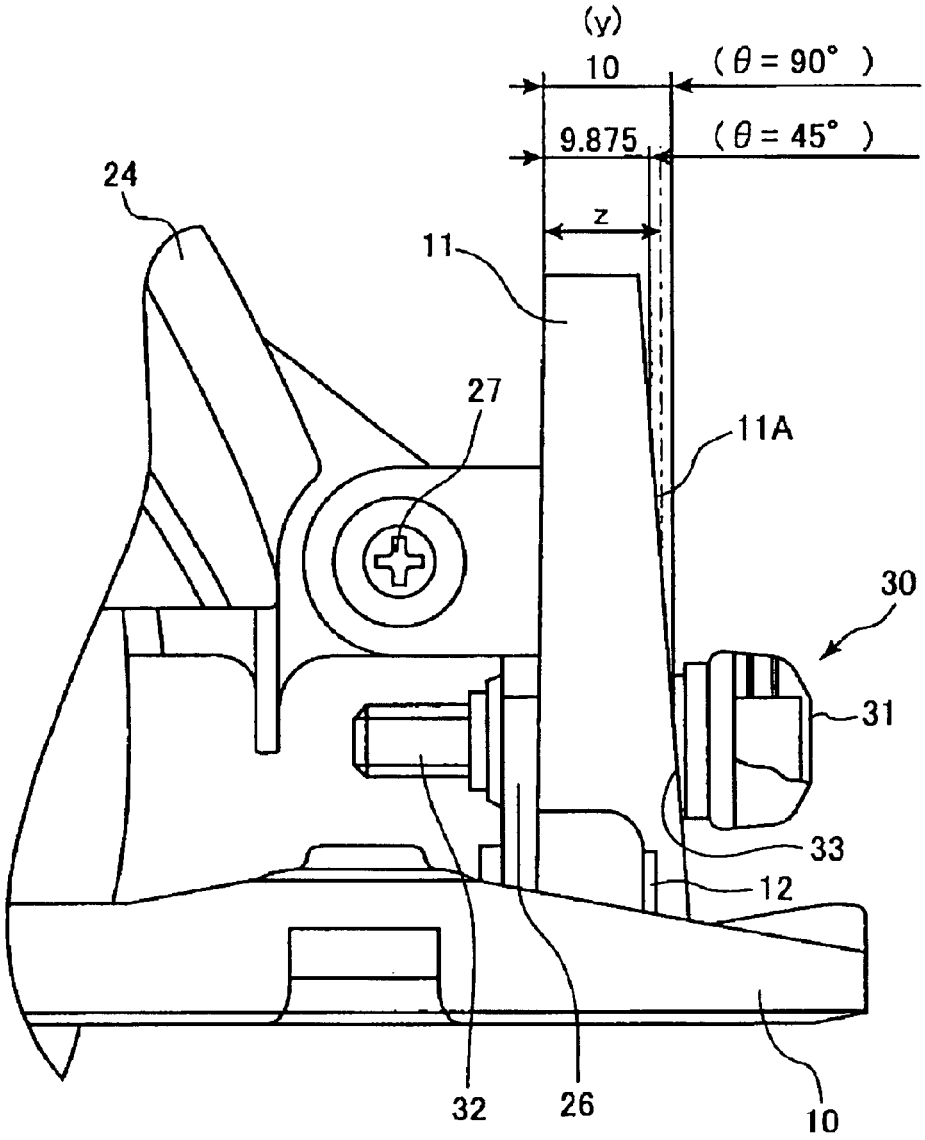
FIG. 4 is an enlarged side view particularly showing a slant position fixing member, a tiltable plate, and a fastening unit in the portable circular saw according to the first embodiment.
Figure 5:
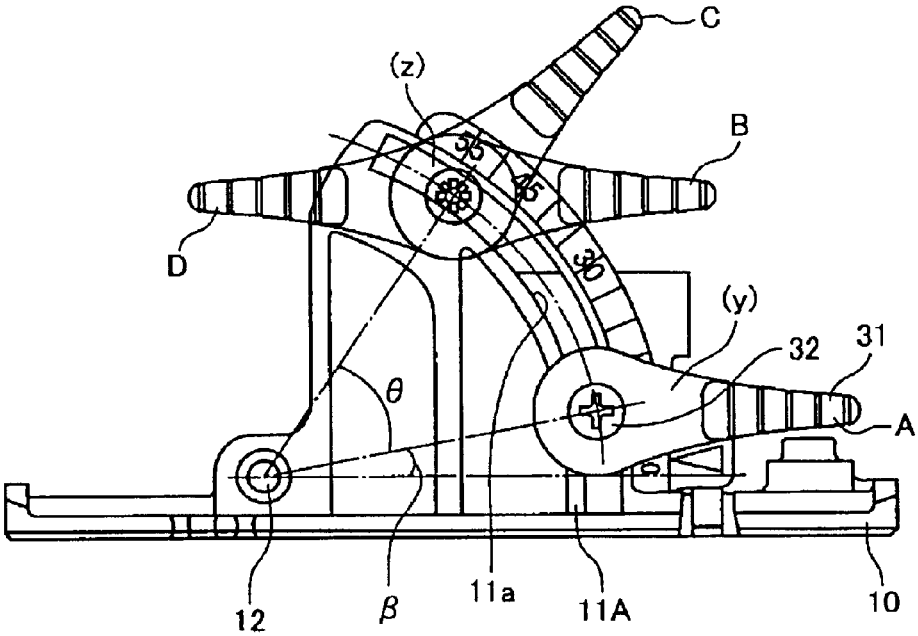
FIG. 5 is view for description of the relationship between a posture of a lever of the fastening unit and angular pivot position of the tiltable plate in the portable circular saw according to the first embodiment.
Figure 6:
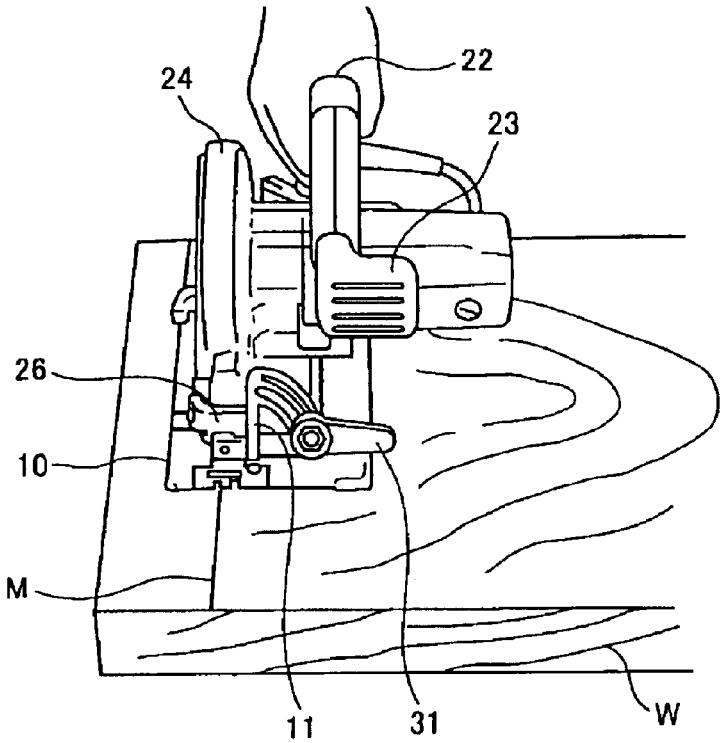
FIG. 6 is a perspective view showing a posture of the portable circular saw in its vertical cutting operation according to the first embodiment.

FIGS. 4 and 5 show the relationship between the slant position fixing member 11 and the fastening unit 30. In these drawings, a vertical orientation of the circular saw blade 21 is provided at an initial phase where the thread 32 is located at the lowermost end of the arcuate slot 11*a*. A thickness "y" of the slant position fixing member 11 is provided at a portion with which the pressure surface 33 is faced in the initial phase. Further, a thickness "z" of the slant position fixing member 11 is provided at its-another portion with which the pressure surface 33 is faced, in a case where the circular saw blade 21 is tilted at an angle θ relative to the base 10. Furthermore, provided that a pitch of the thread 32 is "p", and the lever 31 is oriented in a horizontal posture as shown by a character A in FIG. 5 when the lever 31 is completely fastened in the initial phase. In the latter case, the thread 32 is angularly positioned at an angle β from the base 10.

Taking the above condition in mind, the abutment surface 11A must meet with the following relationship:

$$z \leqq y-(\theta/360)p$$

According to this inequality, the thread 32 can at least further rotate by (θ/360)p, which prevents the free end of the lever 31 from being positioned higher than the thread 32. In other words, the free end can still be positioned at the same level of the thread 32 as shown by a position B in FIG. 5. However, if (y−z) is excessively large, rotatable angle of the lever 31 becomes also excessive, and may further be rotated in a clockwise direction in FIG. 5 to a posture C after the posture of D, i.e., almost 300 degrees rotation from the position B to the position C. Maximum allowable further rotation angle from the position B is 180 degrees, i.e., the position D in the clockwise direction in FIG. 5. Therefore, the following relationship must also be satisfied.

$$z \leqq y-(p/2)-(\theta/360)p$$

With this inequality, maximum pivot position of the lever 31 is shown by the position D in FIG. 5, in which the free end of the lever 31 is not positioned higher than the thread 32. Accordingly, the lever 31 does not become an obstacle for observing the marking line M during angled cutting operation.

More specifically, provided that the tilting angle of the circular saw blade 21 is in a range of from 0 degree to 55 degrees, a thread pitch P of the thread 32 is 1 mm, and the thickness y is 10 mm. The abutment surface 11A is configured such that the thickness of the slant position fixing member 11 is gradually small in accordance with an increase in tilting angle of the circular saw blade 21. In case the tilting angle of the circular saw blade 21 is 45 degrees, the thickness z is calculated to 9.875 mm. Further, as shown in FIG. 5, provided that the lever 31 extends in parallel with the base 10 upon clamping of the lever 31 when the tilting angle θ is 0 degree. The thickness of the slant position fixing member 11 at the tilting angle θ of 45 degrees is smaller than the thickness y (10 mm) by 0.125 mm (10−9.875), and therefore, the thread 32 can be further rotated in case of θ=45 because of the thickness difference. Because a pitch of the thread is 1 mm, this difference corresponds to an angle 45 degrees (360×0.125=45). That is, the lever 31 can be further rotated by 45 degrees in comparison with the case where the tilting angle is zero. Consequently, the lever 31 can also extends in parallel with the base 10 even in case of the tilting angle of 45 degrees.

With this arrangement, in cutting the workpiece W from its rear end toward the front end while the posture of the circular saw blade 21 is vertically fixed, the safety cover 28 (FIG. 2) is automatically pivotally moved about saw blade shaft 21A to expose the lower half region of the circular saw blade 21. The main body 20 is pushed onto the workpiece W while the main handle 22 is gripped by a right hand and the subordinate handle 23 is held by a left hand, and the base 10 is slidingly moved onto the workpiece W frontwardly. In this case, since the lever 31 is directed substantially in parallel with the base 10, a portion of the workpiece W immediately in front of the circular saw blade 21 can be easily obvserved, so that the operator can easily perform cutting operations while visualizing the marking line M. Further, a finger pressing the subordinate handle 23 does not abut the lever 31.

In case of the window formation where the circular saw blade 21 must be moved from the front to the rear of the workpiece W, a finger is latched to the safety cover lever 25 to maintain an open phase of the safety cover 28. That is, during window forming operation, the safety cover lever 25 must be held at its frontward pivot position as shown in FIG. 1 for manually opening the safety cover 28. Here, the subordinate handle 23 is positioned at a front side of the main body 20 as close as possible. Therefore, the frontward pivot position of the safety cover lever 25 can be positioned close to the subordinate handle 23. Consequently, access or holding to the safety cover lever 25 and the subordinate handle 23 can be easily achieved by a single hand.

Figure 7:
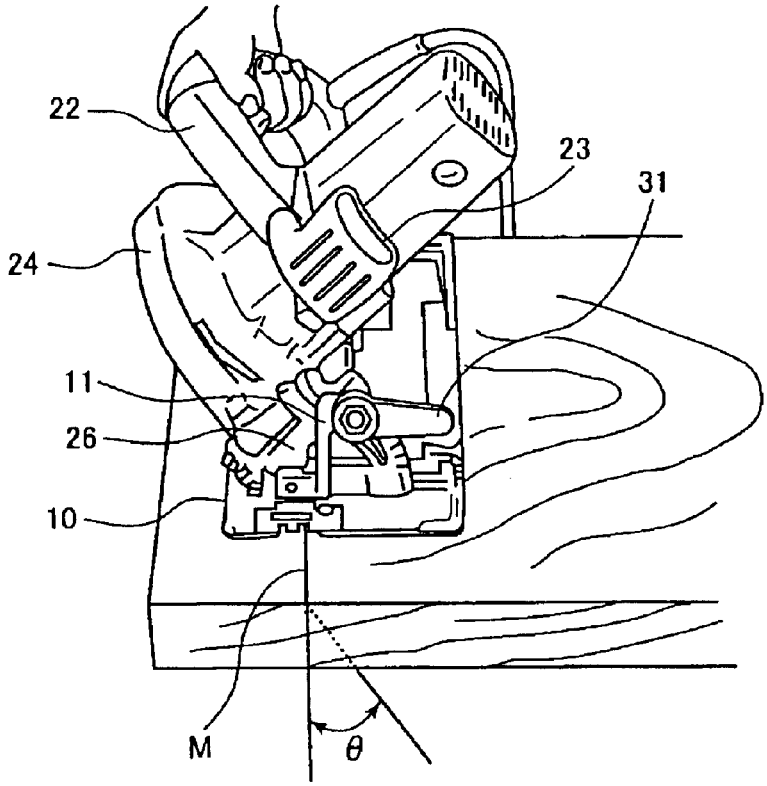
FIG. 7 is a perspective view showing another posture of the portable circular saw in its angled cutting operation according to the first embodiment.

Further, in case of the angled cutting shown in FIG. 7, the lever 31 is temporarily unfastened to allow the main body 20 to pivotally moved about the pin 12 with respect to the base 10 so as to provide a desired angle θ of the circular saw blade 21 relative to the base 10. By the pivotal movement, the position of the tiltable plate 26 relative to the slant position fixing member 11 is changed. Then, the lever 31 is fastened for maintaining the relative position between the slant position fixing member 11 and the tiltable plate 26 to fix the tilting angle of the circular saw blade 21.

In case of the angled cutting, since the lever 31 is directed substantially in parallel with the base 10 or the free end of the lever 31 is positioned lower than the thread 32, the workpiece portion immediately in front of the circular saw blade 21 can be easily observed, facilitating cutting while visualizing the marking line M. Further, the finger of the hand pressing the subordinate handle 23 does not abut the lever 31, providing a sufficient operability. This implies that the subordinate handle 23 can be disposed as frontward as possible from the main body 20. As a result, a distance between the main handle 22 and the subordinate handle 23 can be increased as much as possible to provide a balanced holding to the portable circular saw 1. Furthermore, the subordinate handle 23 is positioned remote from the circular saw blade 21 in the axial direction of saw blade shaft 21A as long as possible. In such a case, the finger pressing the subordinate handle 23 does not abut the lever 31.

Further, in any kind of cutting or grooving, the thickness of the slant position fixing member 11 is gradually increased downwardly. Therefore, pressing the main body 20 toward the workpiece W will increase the pressing force of the pressure surface 33 of the fastening unit 30 aginst the abutment surface 11A. Consequently, accidental downward pivotal movement of the tiltable plate 26 together with the pivotal movement of the main body 20 toward the base 10 can be prevented.

Moreover, in case where the main body 20 is oriented in its hip-up posture by adjusting the cutting depth adjusting mechanism 40, the position of the subordinate handle 23 is further lowered. However, since the free end of the lever 31 is not directed upwardly, interference of the finger holding the subordinate handle 23 with the lever 31 can still be avoided, to thus enhance operability.

Figure 8:
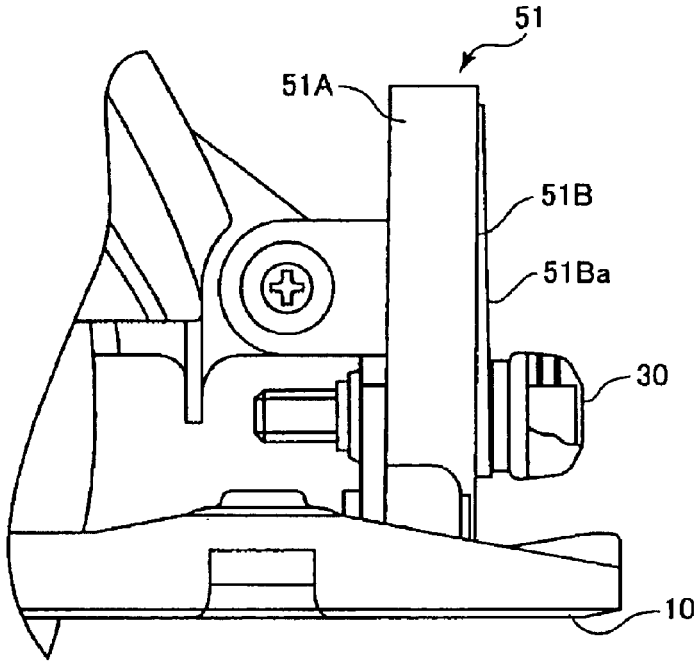
FIG. 8 is a side view showing an essential portion of a portable circular saw according to a second embodiment of the present invention.

A portable circular saw according to a second embodiment of the present invention will be described with reference to FIG. 8. In the first embodiment, the slant position fixing member 11 is constituted by a single component in which the abutment surface 11A in pressure contact with the pressure surface 33 is a slant plane whereas another side opposite to the abutment surface 11A is a flat plane extending substantially perpendicular to the base 10. In contrast, in the second embodiment, a slant position fixing member 51 includes a main fixing member 51A whose thickness is uniform in its height, and an adjustment plate 51B having a fixing surface fixed to the main fixing member 51A and a pressure contact surface 51Ba slanted at a predetermined gradient. The adjustment plate 51B can be formed of a light weight metal.

With this arrangement, the main fixing member 51A can be roughly machined as long as the adjustment plate 51B is precisely machined. Thus, the resultant slant position fixing member 51 can be produced easily. If necessary, a sheet like member can be interposed between the main fixing member 51A and the adjustment plate 51B for finely controlling the inclination angle of the pressure contact surface 51Ba.

Figure 9:
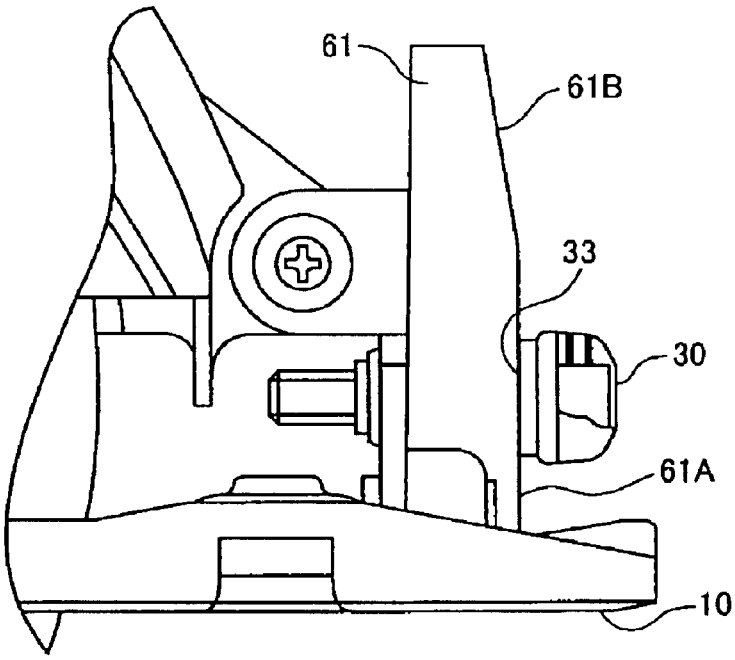
FIG. 9 is a side view showing an essential portion of a portable circular saw according to a third embodiment of the present invention.

FIG. 9 shows a portable circular saw according to a third embodiment of the present invention. In the third embodiment, a slant position fixing member 61 has a two stage abutment surface including a vertical surface 61A extending perpendicular to the base 10 and a slant surface 61B gradually reducing a thickness of the slant position fixing member 61 upwardly.

With this arrangement, a rising-up tendency of the free end of the lever 31 is permitted by the vertical surface 61A at a small tilting angle range of the main body 20, which range will provide a lesser rising-up tendency of the free end. On the other hand, the rising-up tendency is prevented by the slant surface 61B at a greater tilting angle range of the main body 20, which range will provide an increased rising-up tendency unless the slant surface 61B is provided.

Figure 10:
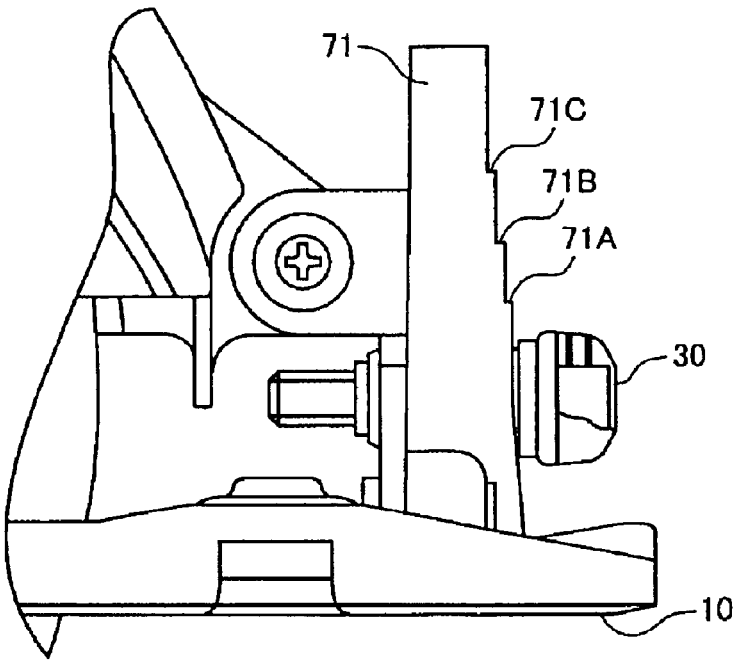
FIG. 10 is a side view showing an essential portion of a portable circular saw according to a fourth embodiment of the present invention.

FIG. 10 shows a portable circular saw according to a fourth embodiment of the present invention. In the fourth embodiment, a slant position fixing member 71 has a plurality of stepped abutment surfaces 71A, 71B, 71C those in pressure contact with the pressure surface 33 of the fastening unit 30. With this arrangement, these stepped abutment surfaces 71A, 71B, 71C correspond to typical slant angles of the circular saw blade 21 such as 15 degrees, 30 degrees, and 45 degrees, respectively. The pressure contact surface 33 of the fastening unit 30 can be subjected to positioning with a sense of click when the main body 20 is tilted to the one of the desired postures. Thus, an intended slant angle of the circular saw blade 21 can be easily fixed.

Figure 11:
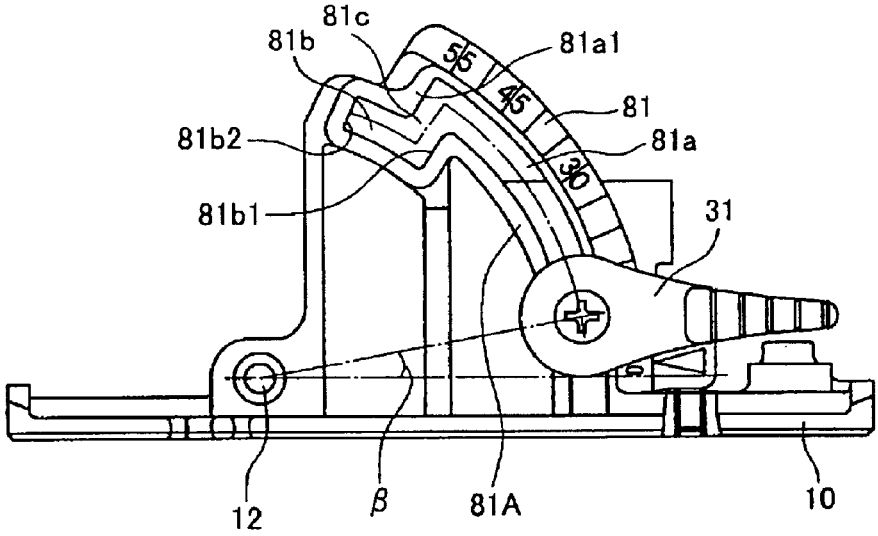
FIG. 11 is a side view showing a slant position fixing member and a lever in a portable circular saw according to a fifth embodiment of the present invention.
Figure 12:
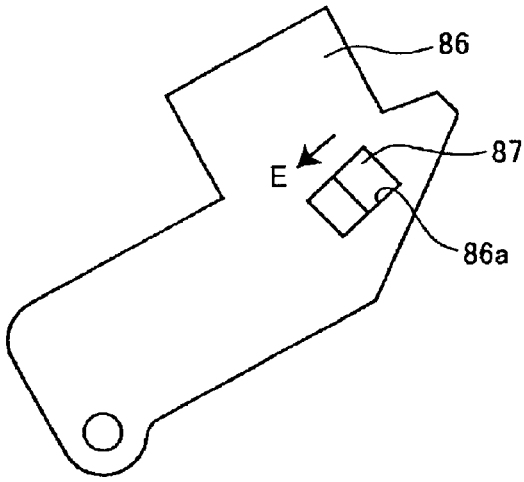
FIG. 12 is a view showing a link plate used in the portable circular saw according to the fifth embodiment.
Figure 13:
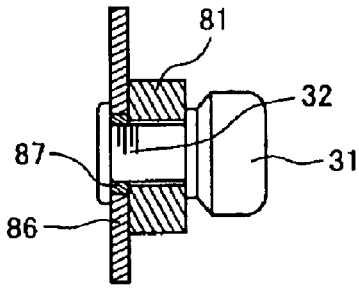
FIG. 13 is a cross-sectional view showing a connection between the link plate and a thread member in the portable circular saw according to the fifth embodiment.

FIGS. 11 through 13 show a portable circular saw according to a fifth embodiment of the present invention. In the fifth embodiment, a slant position fixing member 81 is formed with a second arcuate slot 81*b* at an upper stroke end position of a first arcuate slot 81*a*. Further, a link plate 86 is provided to a tiltable plate corresponding to the tiltable plate 26 in the foregoing embodiments.

More specifically, the first arcuate slot 81*a* and the second arcuate slot 81*b* allow the thread 32 to pass therethrough, and have a common center of radius coincident with the pivot axis of the tiltable plate, i.e., the axis of the pin 12 (FIG. 1). The first arcuate slot 81*a* permits pivotal movement of the circular saw blade 21 from its initial vertical position (zero degree) to 45 degrees. The second arcuate slot 81*b* has a radius smaller than the radius of the first slot 81*a* and permits pivotal movement of the circular saw blade 21 from 45 degrees to its maximum slant angle of 55 degrees. An uppermost end of the first arcuate slot 81*a* and a base end of the second arcuate slot 81*b* are communicated with each other by a radial slot 81*c*. Thus, the thread 32 is movable through a cranked path indicated by a dotted chain line in FIG. 11.

A link plate 86 is fixed to the tiltable plate. The link plate 86 is formed with a guide groove 86*a* having a rectangular shape for allowing the thread 32 to move in the radial slot 81*c* in a radial direction of the slot 81*a* or 81*b*. A thread member 87 threadingly engageable with the thread 32 is disposed slidably within the guide groove 86*a* and unremovably therefrom. An abutment surface 81A of the slant position fixing member 81 in pressure contact with the pressure surface of the fastening unit 30 is slanted similar to the foregoing embodiments. Incidentally, the thread 32 is positioned at an angle β from the base 10 when the circular saw blade 21 is in its vertical posture. Therefore, angle scale formed in the slant position fixing member 81 is displaced by angle β.

With this arrangement, if the slant angle of the circular saw blade 21 is less than 45 degrees, the thread 32 is moved within the first slot 81*a*. The lever 31 is fixed when the circular saw blade 21 becomes a desired slant angle.

In order to fix the slant angle of the circular saw blade 21 to 45 degrees, when the thread 32 is moved to the stroke end 81*a*1 of the first arcuate slot 81*a*, the thread 32 can be moved radially inwardly within the radial slot 81*c*. When the thread 32 is manually moved radially inwardly, the thread member 87 in threadingly engaging relation to the thread 32 is slidingly moved within the guide groove 86*a* in a direction indicated by an arrow E in FIG. 12. Thus, the slant angle 45 degrees of the circular saw blade 21, which angle is the typical angled cutting angle, can be easily provided. Further, the thread 32 can be introduced into the second arcuate slot 81*b* for providing the slant angle of the circular saw blade 21 more than 45 degrees.

While the invention has been described in detail with reference to specific embodiments thereof, it would be apparent to those skilled in the art that various changes and modifications may be made therein without departing from the spirit and scope of the invention.

For example, the pressure contact surface 51Ba of the adjusting plate 51B in the second embodiment can be formed into stepped surfaces of the fifth embodiment. Further, the pressure contact surface 51Ba of the second embodiment can have a vertical plane and a slant plane corresponding to the vertical plane 61A and slant plane 61B of the third embodiment.

What is claimed is:

1. A portable circular saw comprising:

a base to be opposed to a workpiece, the base having a front portion and a rear portion in a cutting direction;

a main body rotatably supporting a circular saw blade and pivotally movable relative to the base;

a slant position fixing member upstanding from the front portion of the base, the slant position fixing member having an abutment surface;

a tiltable plate connected to the main body and positioned in confrontation with the slant position fixing member and pivotally movable relative to the base about a pivot axis; and a fastening unit comprising:

a thread member having a thread passing through the slant position fixing member and threadingly engaged with the tiltable plate, the thread member having a rotation axis, and a lever member provided at one end of the thread and having a pressure surface in pressure contact with the abutment surface of the slant position fixing member for fixing the tiltable plate to the slant position fixing member to maintain a desired slant angle of the circular saw blade with respect to the base, the abutment surface being configured to allow an angle of rotation of the thread member about the rotation axis to be increased in accordance with an increase in slant angle of the circular saw blade.

2. The portable circular saw as claimed in claim 1, wherein the abutment surface is a slant surface directing in a predetermined gradient.

3. The portable circular saw as claimed in claim 2, wherein the slant position fixing member comprises a main fixing body having a uniform thickness in an upstanding direction, and an adjustment plate having a first surface attached to the main fixing body and a second surface including the slant surface.

4. The portable circular saw as claimed in claim 1, wherein the slant position fixing member is formed with an arcuate slot having a center of radius coincident with the pivot axis of the tiltable plate and allowing the thread member to pass therethrough, the arcuate slot providing a lowermost end, and wherein the abutment surface is configured so as to meet with the following relationships:

$$z \leqq y-(\theta/360)p, \text{ and}$$

$$z \leqq y-(p/2)-(\theta/360)p$$

where "y" stands for a thickness of a first portion of the slant position fixing member with which the pressure surface is in pressure contact in case of an initial phase when the thread member is positioned at the lowermost end and the lever is oriented in substantially parallel with the base upon clamping state thereof, "z" stands for a second portion of the slant position fixing member with which the pressure surface is in pressure contact in case where the circular saw blade is slanted at an angle θ measured from the initial phase and with respect to the base, and "p" stands for a pitch of the thread.

5. The portable circular saw as claimed in claim 1, wherein the abutment surface comprises a vertical surface extending from and perpendicular to the base, and a slant surface connected to the vertical surface and slanted to gradually reduce a thickness of the slant position fixing member upwardly.

6. The portable circular saw as claimed in claim 1, wherein the slant position fixing member is formed with an arcuate slot having a center of radius coincident with the pivot axis of the tiltable plate and allowing the thread member to pass therethrough, the arculate slot including a first arcuate slot having a first radius and allowing the circular saw blade to be slanted within a first angle ranging from an initial vertical position to a predetermined angle, the first arcuate slot having a terminal end;

a second arcuate slot having a second radius different from the first radius and allowing the circular saw blade to be slanted within a second angle ranging from the predetermined angle to a maximum slant angle, the second arcuate slot having an initial end; and a radial slot extending in a radial direction of the first and second arcuate slots and communicating the terminal end with the initial end.

7. The portable circular saw as claimed in claim 6, wherein the tiltable plate comprises:

a main plate body connected to the main body and positioned in confrontation with the slant position fixing member;

a link plate fixed to the main plate body and formed with a guide groove for permitting the thread member to move in the radial direction within the radial slot; and a second thread member threadingly engaged with the thread member and disposed slidably with respect to the guide groove.

8. The portable circular saw as claimed in claim 1, wherein the abutment surface includes a plurality of stepped surfaces each for defining each specific slant angle of the circular saw blade.

9. The portable circular saw as claimed in claim 1, wherein the main body has a top portion and a front portion, and the portable circular saw further comprising a main handle disposed at the top portion, and a subordinate handle disposed at the front portion and at a position as low as possible.

10. The portable circular saw as claimed in claim 9, wherein the subordinate handle is positioned farther from the circular saw blade than is the thread member.

11. The portable circular saw as claimed in claim 9, further comprising a hip up position adjusting mechanism disposed at the rear portion of the base for holding a desired front-low rear-high position of the main body, whereby a cutting depth of the circular saw blade is controllable.

12. A portable circular saw comprising:

a base to be opposed to a workpiece, the base having a front portion and a rear portion in a cutting direction;

a main body rotatable supporting a circular saw blade and pivotally movable relative to the base;

a slant position fixing member upstanding from the front portion of the base for fixing a slant angle of the circular saw blade, the slant position fixing member having an abutment surface;

a tiltable plate connected to the main body and positioned in confrontation with the slant position fixing member and pivotally movable relative to the base about a pivot axis; and a fastening unit comprising:

a thread member having a thread passing through the slant position fixing member and threadingly engaged with the tiltable plate, and a lever member provided at one end of the thread and having a pressure surface in pressure contact with the abutment surface of the slant position fixing member for fixing the tiltable plate to the slant position fixing member to maintain a desired slant angle of the circular saw blade with respect to the base, the abutment surface being configured so that an amount of the thread passing through the slant position fixing member is increased in accordance with an increase in slant angle of the circular saw blade.

13. The portable circular saw as claimed in claim 12, wherein the abutment surface is a slant surface directing in a predetermined gradient.

14. The portable circular saw as claimed in claim 12, wherein the slant position fixing member comprises a main fixing body having a uniform thickness in an upstanding direction, and an adjustment plate having a first surface attached to the main fixing body and a second surface including the slant surface.

15. The portable circular saw as claimed in claim 12, wherein the slant position fixing member is formed with an arcuate slot having a center of radius coincident with the pivot axis of the tiltable plate and allowing the thread member to pass therethrough, the arcuate slot providing a lowermost end, and wherein the abutment surface is configured so as to meet with the following relationships:

$$z \leqq y-(\theta/360)p, \text{ and}$$

$$z \leqq y-(p/2)-(\theta/360)p$$

where "y" stands for a thickness of a first portion of the slant position fixing member with which the pressure surface is in pressure contact in case of an initial phase when the thread member is positioned at the lowermost end and the lever is oriented in substantially parallel with the base upon clamping state thereof, "z" stands for a second portion of the slant position fixing member with which the pressure surface is in pressure contact in case where the circular saw blade is slanted at an angle θ measured from the initial phase and with respect to the base, and "p" stands for a pitch of the thread.

16. The portable circular saw as claimed in claim 12, wherein the abutment surface comprises a vertical surface extending from and perpendicular to the base, and a slant surface connected to the vertical surface and slanted to gradually reduce a thickness of the slant position fixing member upwardly.

17. The portable circular saw as claimed in claim 12, wherein the slant position fixing member is formed with an arcuate slot having a center of radius coincident with the pivot axis of the tiltable plate and allowing the thread member to pass therethrough, the arculate slot including a first arcuate slot having a first radius and allowing the circular saw blade to be slanted within a first angle ranging from an initial vertical position to a predetermined angle, the first arcuate slot having a terminal end;

a second arcuate slot having a second radius different from the first radius and allowing the circular saw blade to be slanted within a second angle ranging from the predetermined angle to a maximum slant angle, the second arcuate slot having an initial end; and a radial slot extending in a radial direction of the first and second arcuate slots and communicating the terminal end with the initial end.

18. The portable circular saw as claimed in claim 17, wherein the tiltable plate comprises:

a main plate body connected to the main body and positioned in confrontation with the slant position fixing member;

a link plate fixed to the main plate body and formed with a guide groove for permitting the thread member to move in the radial direction within the radial slot; and a second thread member threadingly engaged with the thread member and disposed slidably with respect to the guide groove.

19. The portable circular saw as claimed in claim 12, wherein the abutment surface includes a plurality of stepped surfaces each for defining each specific slant angle of the circular saw blade.

20. The portable circular saw as claimed in claim 12, wherein the main body has a top portion and a front portion, and the portable circular saw further comprising a main handle disposed at the top portion, and a subordinate handle disposed at the front portion and at a position as low as possible.

21. The portable circular saw as claimed in claim 20, wherein the subordinate handle is positioned farther from the circular saw blade than is the thread member.

22. The portable circular saw as claimed in claim 20, further comprising a hip up position adjusting mechanism disposed at the rear portion of the base for holding a desired front-low rear-high position of the main body, whereby a cutting depth of the circular saw blade is controllable.

* * * * *